US005364246A

United States Patent [19]

Frank et al.

[11] Patent Number: 5,364,246

[45] Date of Patent: Nov. 15, 1994

[54] AGGREGATE FOR FEEDING FUEL FROM SUPPLY TANK TO INTERNAL COMBUSTION ENGINE OF MOTOR VEHICLE

[75] Inventors: Kurt Frank, Schorndorf-Haubersbronn; Uwe Liskow, Kornwestheim; Jochen Thoenissen, Stuttgart; Uwe Loistl, Unterriexingen; Oliver Wahl, Schwieberdingen, all of Germany

[73] Assignee: Robert Bosch GmbH, Stuttgart, Germany

[21] Appl. No.: 126,074

[22] Filed: Sep. 23, 1993

[30] Foreign Application Priority Data

Dec. 3, 1992 [DE] Germany ..... 4240593

[51] Int. Cl.[5] ..... F04C 2/10; F04C 15/00; F03B 11/04

[52] U.S. Cl. ..... 418/15; 418/171; 415/55.1

[58] Field of Search ..... 418/15, 166, 171; 415/55.1, 169.1

[56] References Cited

U.S. PATENT DOCUMENTS 3,242,867 3/1966 Mosbacher ..... 418/171
3,551,079 12/1970 Brundage ..... 418/171

FOREIGN PATENT DOCUMENTS 1194262 6/1965 Germany ..... 415/55.1
4020520 2/1992 Germany .

*Primary Examiner*—John J. Vrablik
*Attorney, Agent, or Firm*—Michael J. Striker

[57] ABSTRACT

An aggregate for feeding fuel from a supply tank to an internal combustion engine of a motor vehicle has a feeding pump having two end walls forming a pump chamber with a suction opening and a pressure opening and a feed element rotatable in the pump chamber so as to supply fuel from the suction opening to the pressure opening. At least one of the end walls is provided with a groove-shaped unloading passage in a region between an end surface of the feeding element and a sealing surface of the one end wall and communicating through a further opening the pump chamber with a low pressure region. The suction opening has an end facing in a rotary direction of the feeding element. The unloading passage is located near the end of the suction opening.

11 Claims, 3 Drawing Sheets

FIG. 1
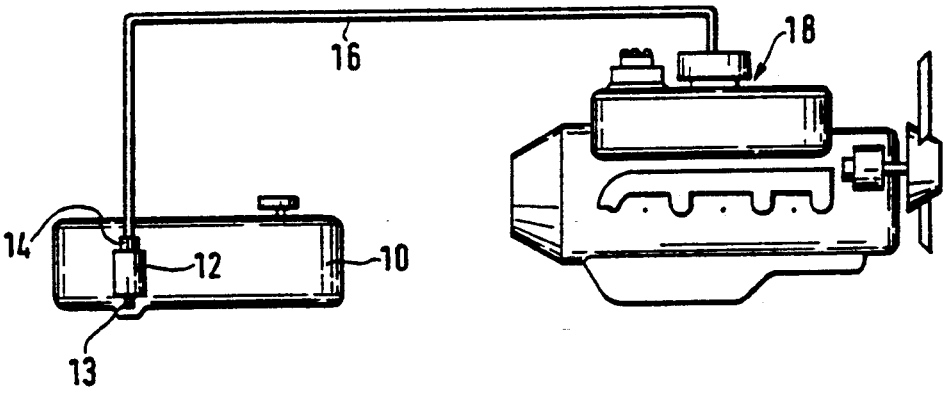
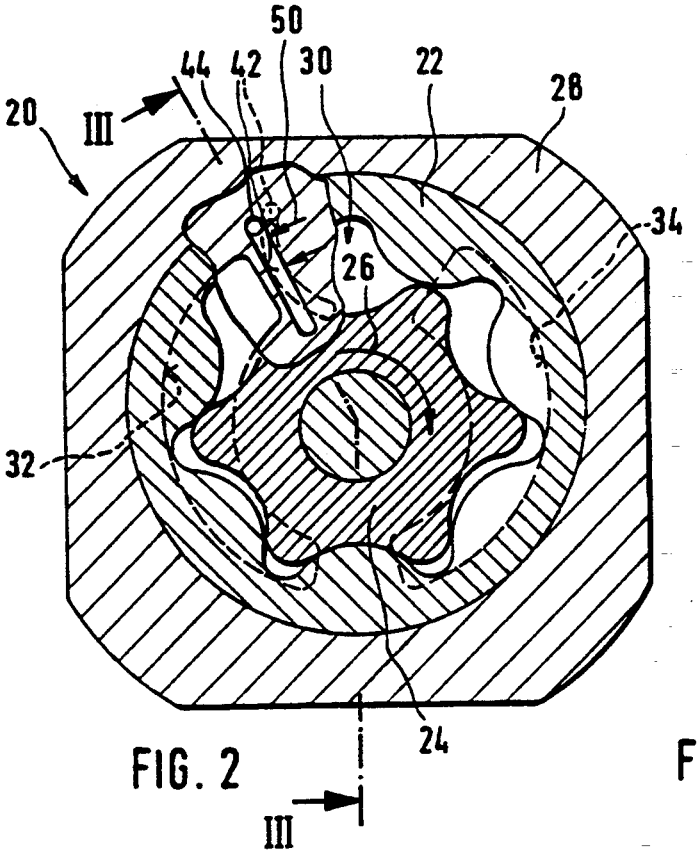
FIG. 2
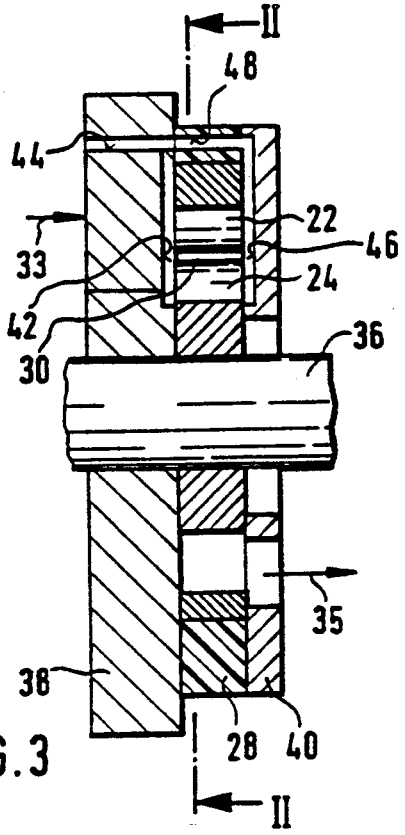
FIG. 3

AGGREGATE FOR FEEDING FUEL FROM SUPPLY TANK TO INTERNAL COMBUSTION ENGINE OF MOTOR VEHICLE

BACKGROUND OF THE INVENTION

The present invention relates to an aggregate for feeding fuel from a supply tank to an internal combustion engine of a motor vehicle.

Aggregates of the above-mentioned general type are known in the art. One such aggregate is disclosed for example in the German patent document DE-A 40 20 520. This aggregate has a rotatingly driven feed element in the form of an impeller arranged in a pump chamber. The impeller supplies fuel from a suction opening which opens in the pump chamber to a pressure opening which leads from the pump chamber. A groove-shaped unloading passage is provided in a chamber wall which limits the pump chamber in the region of a sealing surface. It communicates through a corresponding opening the pump chamber with a region of the system in which the low pressure acts. Gas bubbles are discharged in the unloading passage, which due to the gaps available between the impeller and the pump chamber, flow from the pressure opening to the suction opening and therefore can disturb the operation of the feeding aggregate during their aspiration. The unloading passage is arranged near the pressure opening. It has the disadvantage that the gas bubbles which flow back opposite to the rotary direction of the impeller in front of the unloading passage to the suction opening, can reach the suction opening and again can be aspirated there so as to disturb the operation.

SUMMARY OF THE INVENTION

Accordingly, it is an object of the present invention to provide an aggregate for feeding fuel from a supply tank to an internal combustion engine of a motor vehicle, which avoids the disadvantages of the prior art.

In keeping with these objects and with others which will become apparent hereinafter, one feature of the present invention resides, briefly stated, in an aggregate for feeding fuel from a supply tank to an internal combustion engine, in which, in accordance with the inventive features, the unloading passage is located near an end of the suction opening which end faces the rotary direction of the feed element.

When the feeding aggregate is designed in accordance with the present invention, it eliminates the disadvantages of the prior art. Due to the arrangement of the unloading passage near the suction opening, the gas bubbles which flow back are efficiently carried away and therefore almost no gas bubbles can be again aspirated.

In accordance with another feature of the present invention, the opening extends from the radially outer end region of the unloading passage. With this construction the gas bubbles can be efficiently withdrawn.

In accordance with still another feature of the present invention, an opening is arranged after the end of the suction opening as configured in the rotary direction of the feed element, and extends to an unloading chamber and has approximately the same radial length as the suction opening. In this construction, the unloading passage always deviates the gas bubbles which reach the suction opening through the wall part from the suction opening and thereby further reduces the quantity of the transported gas bubbles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing an arrangement with a fuel supply tank, a fuel feeding aggregate and an internal combustion engine of a motor vehicle;

FIG. 2 is a view showing a cross-section through a feeding pump of the feeding aggregate, taken along the line II—II in FIG. 3, on an enlarged scale;

FIG. 3 is a view showing a longitudinal section of the feeding pump of FIG. 2, taken along the line III—III;

DESCRIPTION OF PREFERRED EMBODIMENTS

Figure 2A:
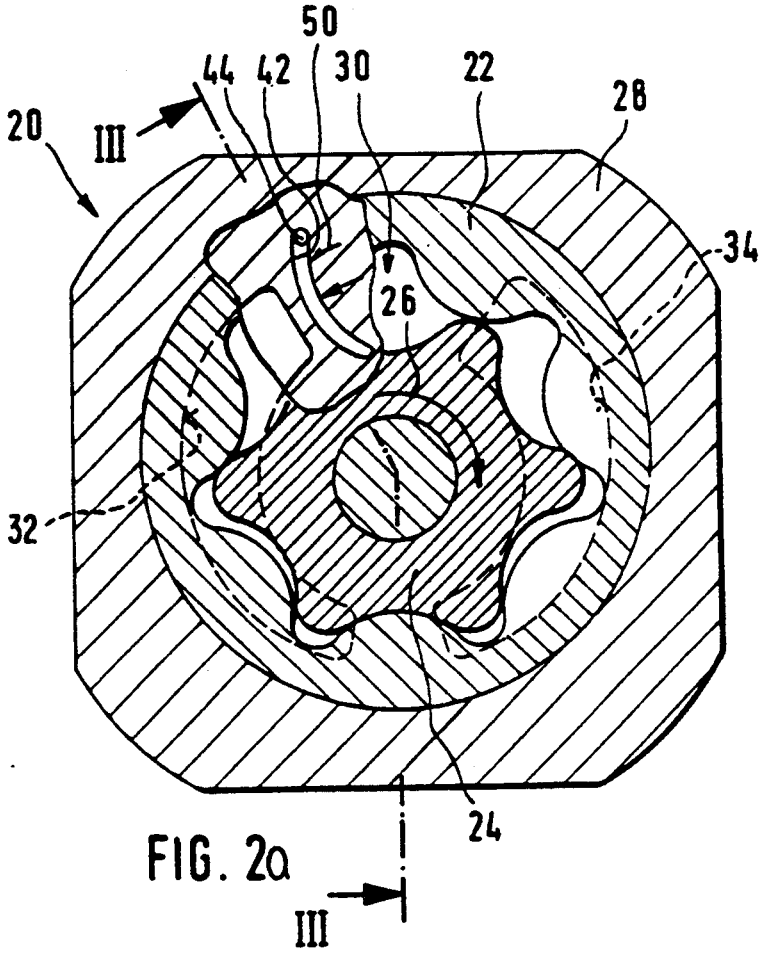
FIG. 2*a* is a view showing a modification of the feeding pump of FIG. 2.

FIG. 1 shows a fuel supply tank 10 in which a fuel feeding aggregate 12 is arranged. A pressure pipe 14 of the fuel feeding aggregate 12 is connected through a pressure conduit 16 to an internal combustion engine 18. During the operation of the internal combustion engine 18, the fuel feeding aggregate 12 aspirates fuel through a suction pipe 13 from the supply tank 10 and transports it to the internal combustion engine 18.

The feeding aggregate 12 has a feeding pump 20 which is shown in FIG. 2. In the illustrated embodiment, the feeding pump is formed as a displacement pump in the form of an inner toothed gear pump. The subsequently described invention is of course not limited to its utilization only in inner toothed gear pumps, but instead can be used also in rotary vane pumps and also in flow pumps. The inner toothed gear pump of the shown embodiment has a feed element formed by a toothed ring 22 provided with inner teeth and a toothed pinion 24 provided with outer teeth. The toothed pinion 24 has less teeth than the toothed ring 22. The toothed pinion 24 is arranged eccentrically relative to the toothed ring 22, so that the toothing of the toothed pinion 24 can engage with the toothing of the toothed ring 22. The toothed ring 22 is supported rotatably over its outer periphery in a housing part 28. The toothed pinion 24 is driven by a not-shown drive into a rotary movement in the direction of the arrow 26 in FIG. 2, and therefore the toothed ring 22 performs a rotary movement in the same direction as the rotary movement of the toothed pinion 24.

During the operation of the displacement pump 20, increasing and reducing pump chambers 30 are formed, through which the medium to be fed is pumped. The toothed ring 22 and the toothed pinion 24 are arranged in a pump chamber which is limited by two cover plates 38 and 40 in the direction of the rotary axes. A sickle-shaped inlet or suction opening 32 is formed in the region of the increasing pump chambers 30, so that the medium to be fed flows into the pump chamber 30 through the suction opening. A similar sickle-shaped outlet or pressure opening 34 is provided in the region of the reducing pump chambers 30 as identified with a dotted line.

FIG. 3 shows a longitudinal section of the feeding pump of FIG. 2. The toothed gear 24 is rotatably supported on a guiding pin 36 which is held at one side in the cover or suction plate 38. The suction opening 32 is formed in the cover plate 38. The further cover or pressure plate 40 is arranged at the side of the toothed ring 22 which is opposite to the cover plate 38. Therefore the pump chambers 30 are closed at both sides in the direction of the rotary axes of the toothed ring 22 and the toothed pinion 24. The end surfaces of the toothed ring 22 and the toothed pinion 24 and the end surfaces of the cover plate 38 and the cover plate 40 which face the toothed pinion and the toothed ring operate as sealing surfaces. The pressure opening 34 is formed in the pressure plate 40. The medium to be fed flows through the suction opening 32 in the direction of the arrow 33 into the pump and is discharged from the pump in the direction of the arrow 35 through the pressure opening 34.

A groove-shaped unloading passage 42 is formed in the end face of the cover plate 38 which faces the toothed pinion 24 and the toothed ring 22 and located after the end of the suction opening 32 as considered in the rotary direction 26 of the toothed pinion 24. The unloading passage 42 extends substantially radially to the rotary axis of the toothed pinion 24, is formed substantially rectilinearly, and extends at least over the radial width of the suction opening 32. The unloading passage 42, as illustrated by a broken line in FIG. 2*a*, can be also curved. In the shown embodiment, the unloading passage 42 extends farther to the rotary axis of the toothed pinion 24 over the inner edge of the suction opening 32 and further radially outwardly over its outer edge. An opening 44 extends from the outer end region of the unloading passage 42 in the cover plate 38 and opens into the supply tank 10. Therefore it connects the unloading passage 42 with a region in which a low pressure acts. Alternatively, or additionally, an unloading passage 46 can be also provided in the end surface of the pressure plate 40 which faces the toothed pinion 24 as shown in FIG. 3. It can be formed and arranged as the above-described unloading passage 42. When both unloading passages 42 and 46 are provided, they are connected with one another by an opening 48 in a housing part 28 which received the toothed ring 22. The openings 44 and 48 are arranged preferably co-axially.

During the operation of the inventive feeding aggregate, the toothed pinion 24 is driven in the rotary direction 26, and the feeding pump 20 aspirates fuel through the suction opening 32 from the supply tank 10 and pumps it through the pressure opening 34. Small gaps remain between the end surfaces of the toothed ring 22 and the toothed pinion 24 and the end surfaces of the cover plate 38 and the cover plate 40. Gas bubbles and leakage fuel available in the pump chamber 30 are pumped in the direction of the arrow 50 in FIG. 2 into the unloading passage 42 or 46. From the unloading passage 42 or 46, the gas bubbles flow through the opening 44 or 48 into the supply tank 10, so that they cannot be directly aspirated by the feeding pump 20. Gas bubbles which flow between the outer radial edge of the toothed ring 22 to the proximity of the inner edge of the toothed pinion 24 supported on the guiding pin 36 toward the suction opening 32 are withdrawn through the radial extension of the unloading passage 42 or 46. The withdrawn gas bubbles can be produced for example by cavitation in certain regions of the feeding pump.

Figure 5A:
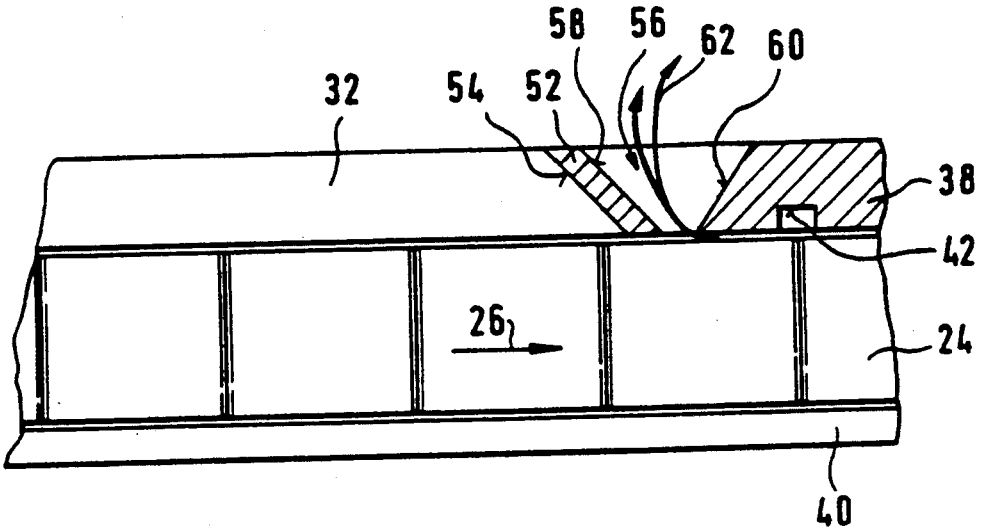
FIG. 5*a* is a view showing a modification of the feeding pump of FIG. 5.
Figure 4:
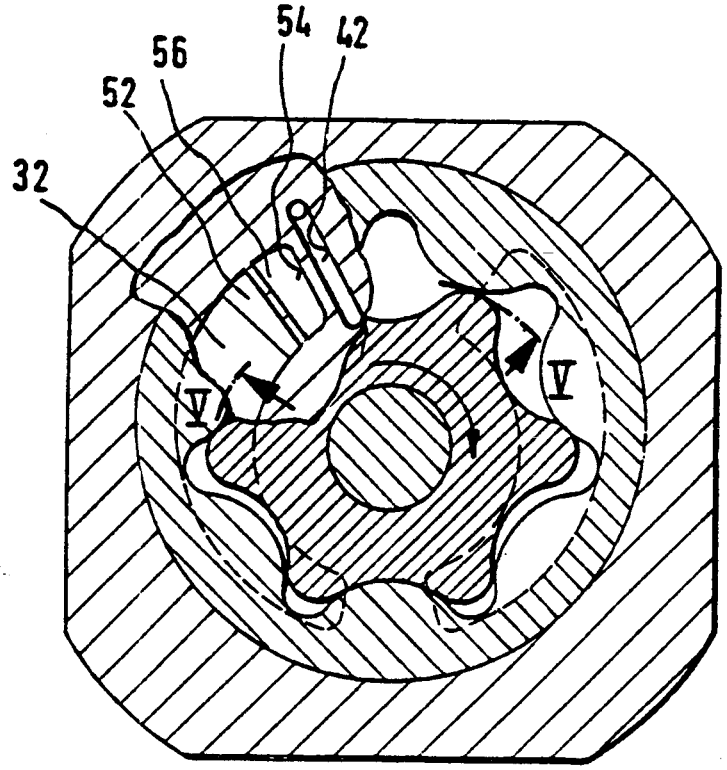
FIG. 4 is a view showing a cross-section of the feeding pump in FIG. 3 in accordance with the second embodiment of the invention.
Figure 5:
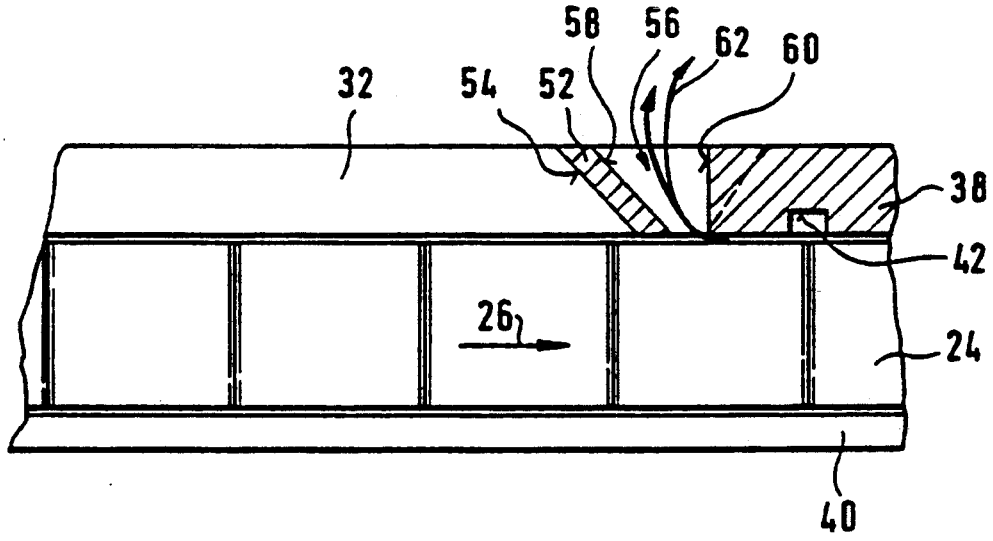
FIG. 5 is a view showing the feeding pump in a development along the line V—V in FIG. 4.

FIG. 4 shows a cross-section of a feeding pump in accordance with a further embodiment of the invention. In the further embodiment, in addition to the unloading passages 42 and 46, an opening 56 is formed in the cover plate 38 near the edge 54 of the suction opening 32 in the rotary direction 26 of the toothed pinion 24. The opening 56 opens into the supply tank 10 which forms an unloading chamber. The opening 56 and the suction opening 32 are separated from one another by a wall part 52. The opening 56 extends radially at least over the same region as the suction opening 32. As shown in FIG. 5, it can be arranged between the edge 54 of the suction opening 32 and the unloading passage 42 or in the rotary direction 26 near the unloading passage 42. FIG. 5 shows a development of a section through the feeding pump along the line V—V in FIG. 4. The edge surface 58 of the opening 56 facing in the rotary direction 26 is inclined, so that with increasing axial distance from the end surface of the toothed pinion 24 it approaches the edge 54 of the suction opening 32, or in other words the opening 56 expands. The edge surface 60 of the opening 56 facing opposite to the rotary direction 26 can be also inclined and in particular opposite to the inclination of the edge surface 58 as shown in FIG. 5*a*, so that thereby the opening 56 also expands. The edge surfaces 56 and 60 can be flat or curved. The edge surface 54 of the suction opening 32 facing opposite to the rotary direction 26 can be also inclined as shown in FIG. 5 and in particular in an opposite direction as compared with the edge surface 58 of the opening 56. Gas bubbles which pass through the gap between the toothed pinion 24 or the toothed ring 22 and the cover plate 38 can be deflected away from the edge surface 58 of the opening 56 facing in the rotary direction 26, axially from the toothed pinion 24 and the toothed ring 22 in the direction of the arrow 62 in FIG. 5. Therefore the gas bubbles cannot be directly aspirated again by the feeding pump and cannot thereby disturb its operation. The gas bubbles which are guided outwardly by the edge surface 58 are entrained by a tangential flow which is available in the region outside the cover plate 38 and rinsed away from the suction opening 32. Due to the inclined arrangement of the other edge surface 60 of the opening 56, the discharge of the gas bubbles and their deviation in the tangential direction are facilitated. The shape and inclination of the edge surface 58 of the wall part 52 depends on the required deviation of the gas bubbles.

It will be understood that each of the elements described above, or two or more together, may also find a useful application in other types of constructions differing from the types described above.

While the invention has been illustrated and described as embodied in an aggregate for feeding fuel from a supply tank to an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding fuel from a supply tank to an internal combustion engine of a motor vehicle, comprising a feeding pump having two end walls forming a pump chamber with a suction opening and a pressure opening and a feeding element rotatable in said pump chamber so as to supply fuel from said suction opening to said pressure opening, at least one of said end walls being provided with a groove-shaped unloading passage in a region between an end surface of said feeding element and a sealing surface of said one end wall and communicating through a further opening said pump chamber with a low pressure region, said suction opening having an end facing in a rotary direction of said feeding element, said unloading passage being located near said end of said suction opening, said unloading passage extending substantially radially with respect to a rotary axis of said feeding element, said unloading passage being arranged closer to said end of said suction opening than a beginning of said pressure opening facing opposite to a rotary direction of said feeding element.

2. An aggregate as defined in claim 1, wherein said unloading passage has a radially outer end region, said further opening extending from said radially outer end region of said unloading passage.

3. An aggregate as defined in claim 1, wherein said unloading passage extends radially outwardly farther than said suction opening.

4. An aggregate as defined in claim 1, wherein said unloading passage extends radially inwardly toward a rotary axis of said feeding element farther than said suction opening.

5. An aggregate as defined in claim 1; and further comprising an additional opening which is arranged in a rotary direction of said feeding element after said end of said suction opening and leads to an unloading space.

6. An aggregate as defined in claim 1, wherein another of said end walls is provided with another said unloading passage.

7. An aggregate as defined in claim 6, wherein said unloading passages of said end walls are connected with one another.

8. An aggregate for feeding fuel from a supply tank to an internal combustion engine of a motor vehicle, comprising a feeding pump having two end walls forming a pump chamber with a suction opening and a pressure opening and a feeding element rotatable in said pump chamber so as to supply fuel from said suction opening to said pressure opening, at least one of said end walls being provided with a groove-shaped unloading passage in a region between an end surface of said feeding element and a sealing surface of said one end wall and communicating through a further opening said pump chamber with a low pressure region, said suction opening having an end facing in a rotary direction of said feeding element, said unloading passage being located near said end of said suction opening; and an additional opening which is arranged in the rotary direction of said feeding element after said end of said suction opening and leads to an unloading space, said additional opening having a radial extension corresponding to a radial extension of said suction opening.

9. An aggregate for feeding fuel from a supply tank to an internal combustion engine of a motor vehicle, comprising a feeding pump having two end walls forming a pump chamber with a suction opening and a pressure opening and a feeding element rotatable in said pump chamber so as to supply fuel from said suction opening to said pressure opening, at least one of said end walls being provided with a groove-shaped unloading passage in a region between an end surface of said feeding element and a sealing surface of said one end wall and communicating through a further opening said pump chamber with a low pressure region, said suction opening having an end facing in a rotary direction of said feeding element, said unloading passage being located near said end of said suction opening; and an additional opening which is arranged in the rotary direction of said feeding element after said end of said suction opening and leads to an unloading space, said additional opening having an edge surface facing in the rotary direction of said feeding element and inclined so that with an increasing distance from said feeding element it approaches in direction of the rotary axis of said feeding element said end of said suction opening.

10. An aggregate as defined in claim 9, wherein said additional opening has an edge surface facing opposite to the rotary direction of said feeding element and inclined so that with an increasing distance from said feeding element it moves away in direction of the rotary axis of said feeding element from said edge surface of said additional opening facing in the rotary direction.

11. An aggregate as defined in claim 9, wherein said edge surface of said additional opening facing the rotary direction of said feeding element is flat.

* * * * *